US007025298B2

(12) United States Patent
Priest et al.

(10) Patent No.: US 7,025,298 B2
(45) Date of Patent: Apr. 11, 2006

(54) CABLE DRIVE ASSEMBLY

(75) Inventors: William L. Priest, Middletown, CT (US); Kevin Wright, Detroit, MI (US); Mark D. Nicholas, Waterford, MI (US); John R. Rice, Chesterfield, MI (US); Ronald J. Wilde, St. Clair Shores, MI (US); Lloyd W. Rogers, Utica, MI (US); Howard W. Kuhlman, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 97 days.

(21) Appl. No.: 10/475,152

(22) PCT Filed: Jun. 18, 2002

(86) PCT No.: PCT/US02/19226

§ 371 (c)(1),
(2), (4) Date: Oct. 14, 2003

(87) PCT Pub. No.: WO02/102615

PCT Pub. Date: Dec. 27, 2002

(65) Prior Publication Data

US 2004/0129821 A1 Jul. 8, 2004

Related U.S. Application Data

(60) Provisional application No. 60/299,304, filed on Jun. 19, 2001.

(51) Int. Cl.
*B65H 75/38* (2006.01)

(52) U.S. Cl. ..... 242/388.8; 49/138

(58) Field of Classification Search ..... 242/388.8, 242/388.2, 388.6, 390.8, 378.4; 49/138, 49/139

See application file for complete search history.

(56) References Cited

U.S. PATENT DOCUMENTS

| | | | |
|---|---|---|---|
| 1,543,845 | A | 6/1925 | Hansen |
| 2,617,315 | A | 11/1952 | McClelland |
| 3,503,275 | A | 3/1970 | Morse |

(Continued)

*Primary Examiner*—Kathy Matecki
*Assistant Examiner*—Sang Kim
(74) *Attorney, Agent, or Firm*—Scott A. McBain

(57) ABSTRACT

A cable drive unit for opening and closing a sliding door on a vehicle (not shown) has a cup-shaped front drum having a helical front cable groove and a rear cup-shaped drum having a helical rear cable groove. The front drum is rotated about a longitudinal axis in a first direction to open the sliding door. The rear drum is partially nested in the front drum and rotated about the longitudinal axis in an opposite direction to close the sliding door. The front drum and the rear drum are drivingly connected to each other via a tension spring that biases the front drum and the rear drum in opposite directions when in tension. The front and rear drums are rotated by a concentric clutch that is nested in the rear drum. The clutch includes a drive member that is drivingly connected to the front drum via a first lost motion connection and drivingly connected to the rear drum via a second lost motion connection. The first drum has an arcuate slot forming part of the first lost motion connection, the rear drum has an arcuate slot forming part of the second lost motion connection, and the drive member has a tab that projects through both arcuate slots to form part of the first lost motion connection and part of the second lost motion connection.

13 Claims, 5 Drawing Sheets

U.S. PATENT DOCUMENTS 4,440,354 A * 4/1984 Kobayashi et al. ..... 242/388.8
4,534,233 A 8/1985 Hamaguchi
5,046,283 A * 9/1991 Compeau et al. ..... 49/138
5,138,795 A * 8/1992 Compeau et al. ..... 49/138
5,316,365 A 5/1994 Kuhlman et al.
5,319,880 A 6/1994 Kuhlman
5,319,881 A 6/1994 Kuhlman
5,350,986 A * 9/1994 Long et al. ..... 318/432
5,396,158 A 3/1995 Long et al.
5,434,487 A * 7/1995 Long et al. ..... 318/286
5,564,231 A 10/1996 Tajima et al.
6,052,946 A 4/2000 Isomura

* cited by examiner

CABLE DRIVE ASSEMBLY

RELATED APPLICATION

This patent application claims benefit of U.S. Provisional patent application 60/299,304 filed Jun. 19, 2001.

TECHNICAL FIELD

This invention relates generally to a sliding door closure apparatus for opening and closing a sliding door on a vehicle.

BACKGROUND OF THE INVENTION

Van type vehicles for passengers and for cargo are frequently equipped with sliding side doors. Rollers support and guide such sliding doors by running in fixed tracks. Sliding doors may be positioned on both sides of a vehicle or a single sliding door may be positioned on one side of the vehicle. However, most vans include a single sliding door positioned on the side of the van opposite the vehicle operator's station. When seated at the vehicle operator's station, a vehicle operator can open or close sliding doors of this type only by leaving the operator's station and either walking around the outside of the vehicle to the sliding door or crossing inside the vehicle to the sliding door. Crossing inside the vehicle is often difficult or impossible due to the presence of cargo and/or passengers positioned inside the van between the operator's station and the door. If a sliding door is positioned on the same side of the van as the operator's station, the operator still must leave the operator's station to open and shut the sliding door from either the inside or outside of the vehicle.

To allow an operator to open and close a sliding door from the operator's station and/or another location remote from the sliding door, power operated sliding door closure systems have been developed. An example of such a system is disclosed in U.S. Pat. No. 5,396,158 which issued Mar. 7, 1995 to Joseph D. Long et al. The Long et al. patent discloses a sliding door closure apparatus that includes a sliding door mounted in a van on rollers and slidably supported in upper, center and lower tracks. An opening and closing module is mounted inside the van adjacent the center track. A front cable is attached to a front cable drive pulley or drum and extends from the front drum to the sliding door through a front cable roller guide assembly. A rear cable is attached to a rear cable drive pulley or drum and extends from the rear drum to the sliding door through a rear cable roller guide assembly. The front and rear cable drive drums each have a large diameter helical cable groove.

A motor drive unit rotates the front and rear cable drive drums to move the sliding door. The motor drive unit, as best shown in FIG. 3 of the '158 patent, comprises an electric motor that drives a drive gear that is coaxially aligned with the front and rear cable drive drums. A lost motion connection is provided between the drive gear and the front cable drive drum in the form of a drive lug that is carried by the drive gear and a complementary drive lug that is carried by the front cable drive drum. A lost motion connection is also provided between the drive gear and the rear cable drive drum in the form of a second drive lug that is carried by the drive spool and a second complementary lug that is carried by the rear cable drive drum. As seen in FIGS. 2 and 3 of the '158 patent, a coil spring is seated in an annular opening in the cable drive drums. An upper spring end is anchored on the rear cable drive drum and a lower spring end is anchored on the front cable drive drum. The coil spring is a tension retaining spring that urges the front cable drive drum in the counterclockwise winding direction and the rear cable drive spool in the opposite clockwise winding direction so that the front and rear cables are maintained in tension at all times.

SUMMARY OF THE INVENTION

According to the invention, a cable drive assembly for opening and closing a sliding door on a vehicle is provided. The drive assembly includes front and rear drums with helical front and rear cable grooves respectively that are supported for rotation about a longitudinal axis. A front cable extends from the front cable groove to a vehicle sliding door in a position to be wound into and unwound from the front cable groove in response to front drum rotation in respective opposing directions about the longitudinal axis. A rear cable extends from the rear cable groove to the sliding door in a position to be unwound from and wound onto the rear cable groove in response to rear drum rotation in respective opposing directions about the longitudinal axis. The cable drive unit also includes a spring that biases the front drum and the rear drum in opposite direction to maintain the front and rear cables in tension.

The front and rear drums are configured to provide a nesting chamber for an electromagnetic clutch resulting in a very compact arrangement in the axial direction. The electromagnetic clutch is preferably coaxially arranged with the drums and the output shaft of an electric motor subassembly to contribute to the axial compactness of the cable drive assembly. The front drum is adapted to drive the side door to a closed position by including a decreasing earn portion that increases the tensile force in the cable to overcome the opposing load created by the door seals during the final closing operation with the cam portion preferably being elliptical to increase cable life.

BRIEF DESCRIPTION OF THE DRAWINGS

These and other features and advantages of the invention will become apparent to those skilled in the art in connection with the following detailed description and drawings, in which.

DETAILED DESCRIPTION OF THE PREFERRED EMBODIMENT

Figure 1:
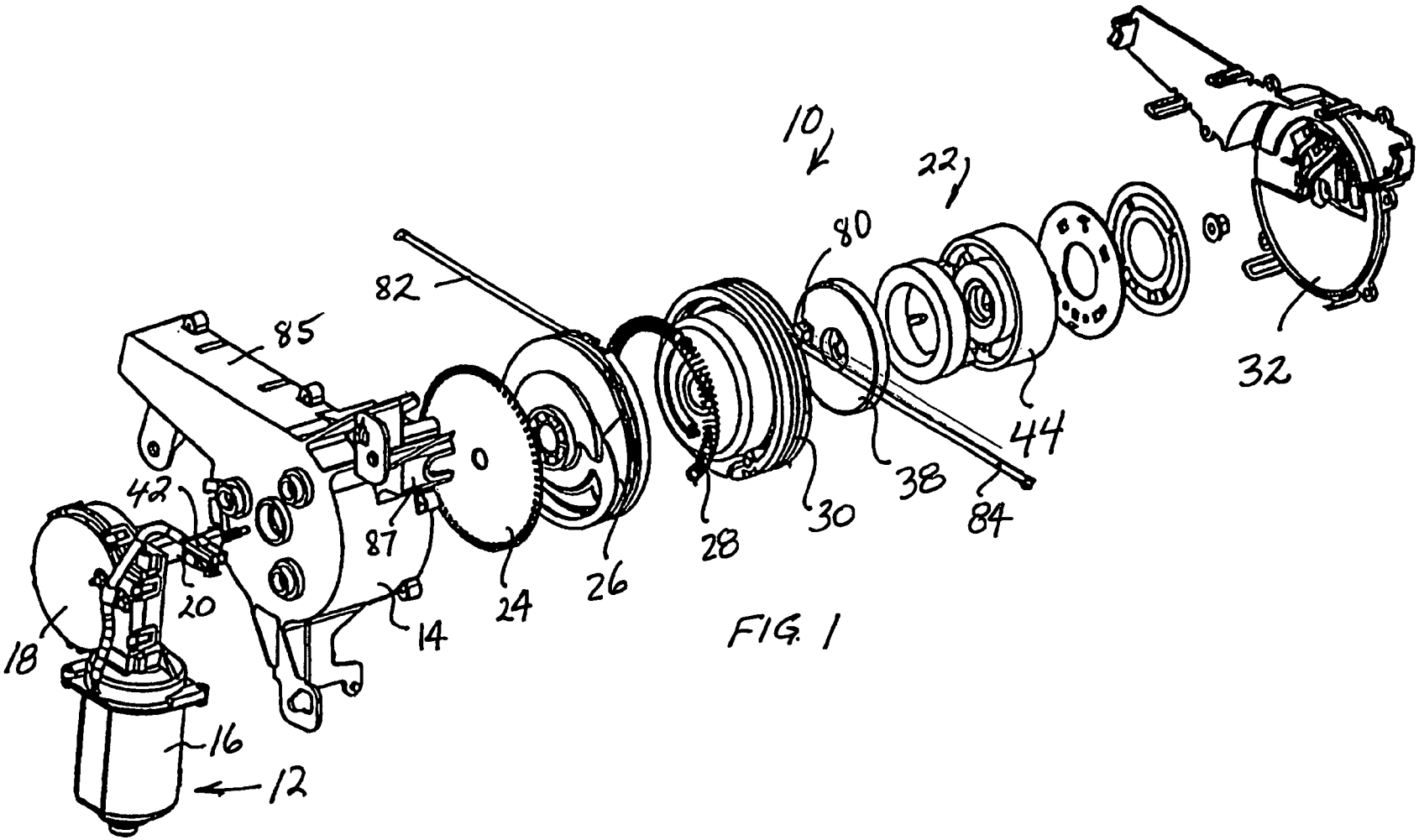
FIG. 1 is an exploded perspective view of a cable drive assembly constructed according to the invention.

The following is a description of a cable drive assembly 10 constructed according to the invention and configured for use in a closed loop cable closure system such as that described in U.S. Pat. No. 5, 396,158 which is incorporated herein by reference.

The cable drive assembly 10 comprises a motor sub-assembly 12 that is attached to the exterior of a housing 14. Motor sub-assembly 12 includes a reversible electric motor 16 that drives a reduction gear unit 18 that has an output shaft 20. Output shaft 20 extends into housing 14 on a longitudinal axis 21 to drive an electromagnetic clutch indicated generally at 22. Electromagnetic clutch 22 is disposed inside housing 14 along with an interrupter 24, a front drum 26, a tension spring 28, and a rear drum 30. Housing 14 is closed by a cover 32.

Interrupter 24 comprises a plate 34 having an integral annular sleeve 36 that is journalled on shaft 20 for concentric rotation about shaft 20 and longitudinal axis 21. Sleeve 36 extends through respective bores of front and rear drums 26, 30 and supports the front and rear drums 26, 30 rotationally on axis 21. The free end of sleeve 36 attaches to a friction output plate 38 of electromagnetic clutch 22. Plate 34 has a plurality of circumferentially spaced windows 40 that cooperate with an optical sensor 42 to determine the speed and location of the van door (not shown) in the opening and closing operations. The output shaft 20 of the motor subassembly 12 extends through the annular sleeve 36 and drives the input member 44 of the electromagnetic clutch 22. Electromagnetic clutch 22 operates in a conventional manner to drive plate 38 when energized while allowing free rotation of plate 38 when deenergized. This facilitates manual operation of the van door by eliminating the necessity to back drive electric motor 16.

Figure 2:
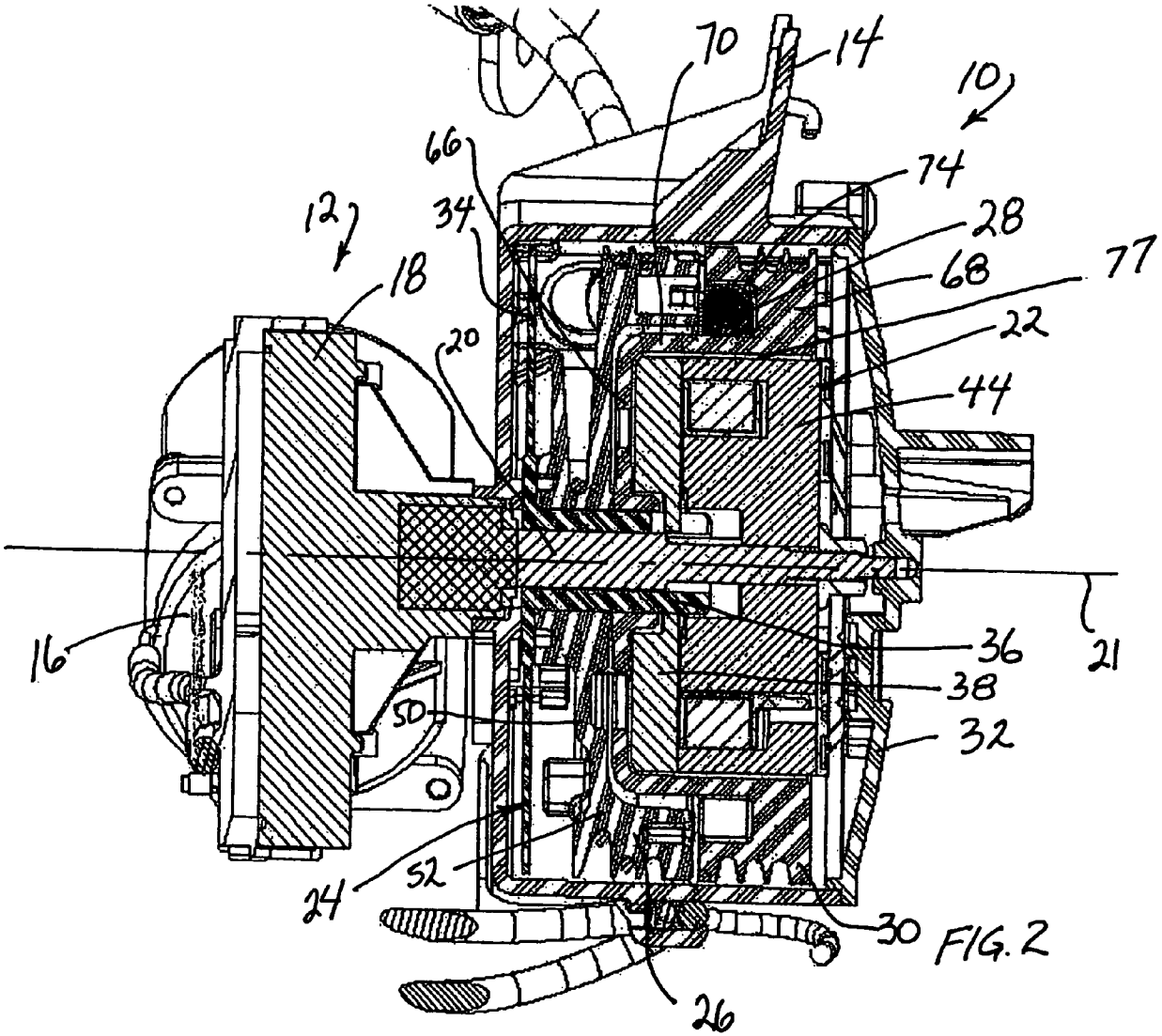
FIG. 2 is longitudinal, partially sectioned view of the cable drive assembly of FIG. 1.
Figure 3:
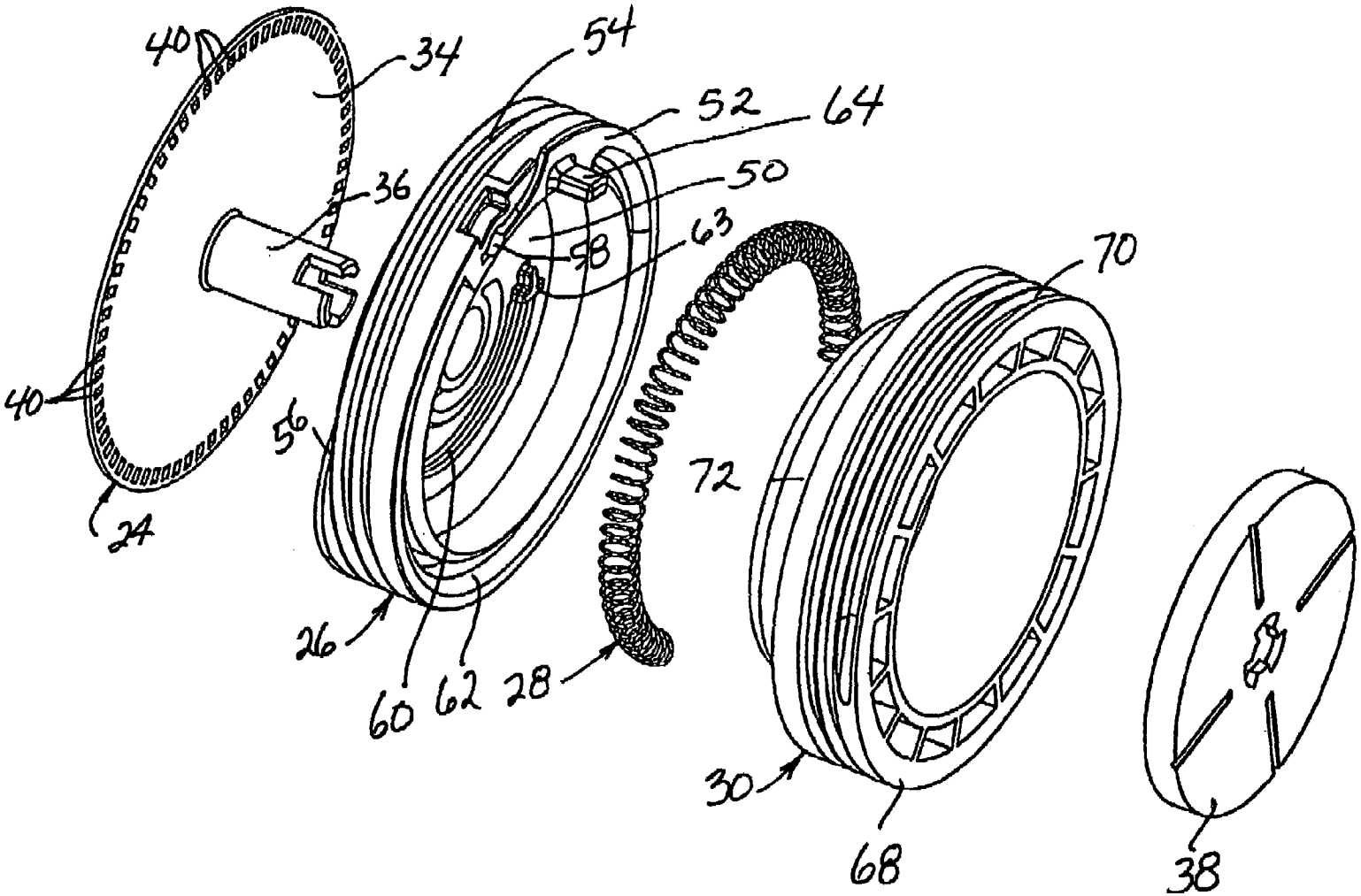
FIG. 3 is an exploded perspective view of part of the cable drive assembly of FIG. 1 taken from a different perspective.
Figure 4:
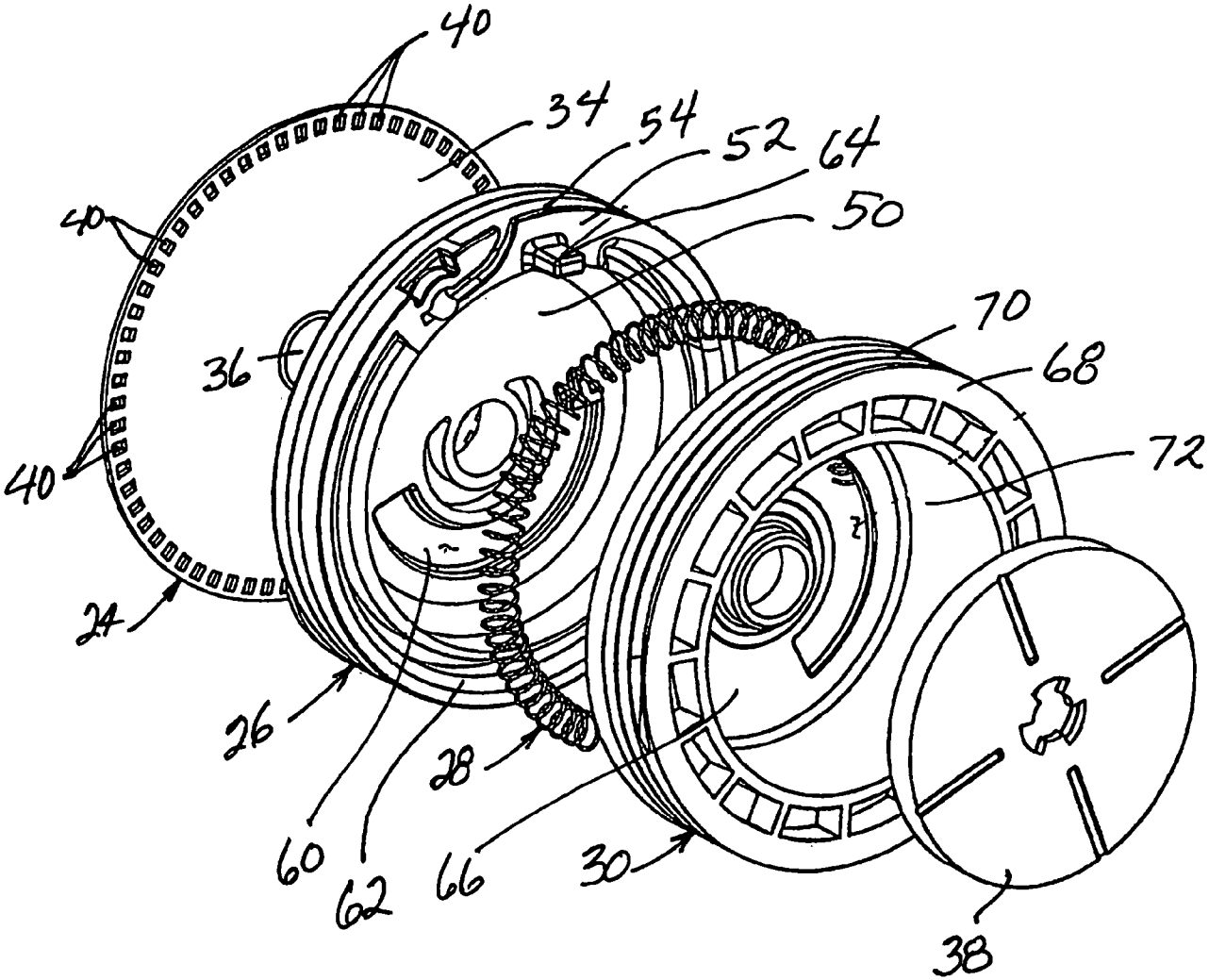
FIG. 4 is an exploded perspective view of the parts shown in FIG. 3 taken from another perspective.

Front drum 26 is cup shaped having an end wall 50 with a large diameter rim 52 that includes a helical front cable groove 54 and a decreasing diameter cam portion 56 on one end that includes a continuation of the front cable groove 54. Front drum 26 has a cable anchor 58 in rim 52 that communicates with the front cable groove 54 at the opposite end as best shown in FIGS. 2 and 3. End wall 50 includes an arcuate lost motion slot 60 while rim 52 includes a spring groove 62 in its end face and a spring tab 64 that projects from the end face of rim 52 in an axial direction.

Rear drum 30 is also cup shaped having an end wall 66 with a large diameter rim 68 that includes a helical rear cable groove 70 and a reduced diameter annular cylindrical wall 72 that connects rim 68 to end wall 66. Rear drum 30 is partially nested in front drum 26 with its rim 68 juxtaposed rim 52 as best shown in figure 2. Rim 68 includes a cable anchor 71 that communicates with helical rear cable groove 70 and a spring cavity 74 that aligns with spring groove 54 so that spring tab 64 extends into spring cavity 74. Spring cavity 74 has an abutment 76 at one end. End wall 66 and reduced diameter cylindrical wall 72 form a nesting chamber 77 for electromagnetic clutch 22.

Figure 5:
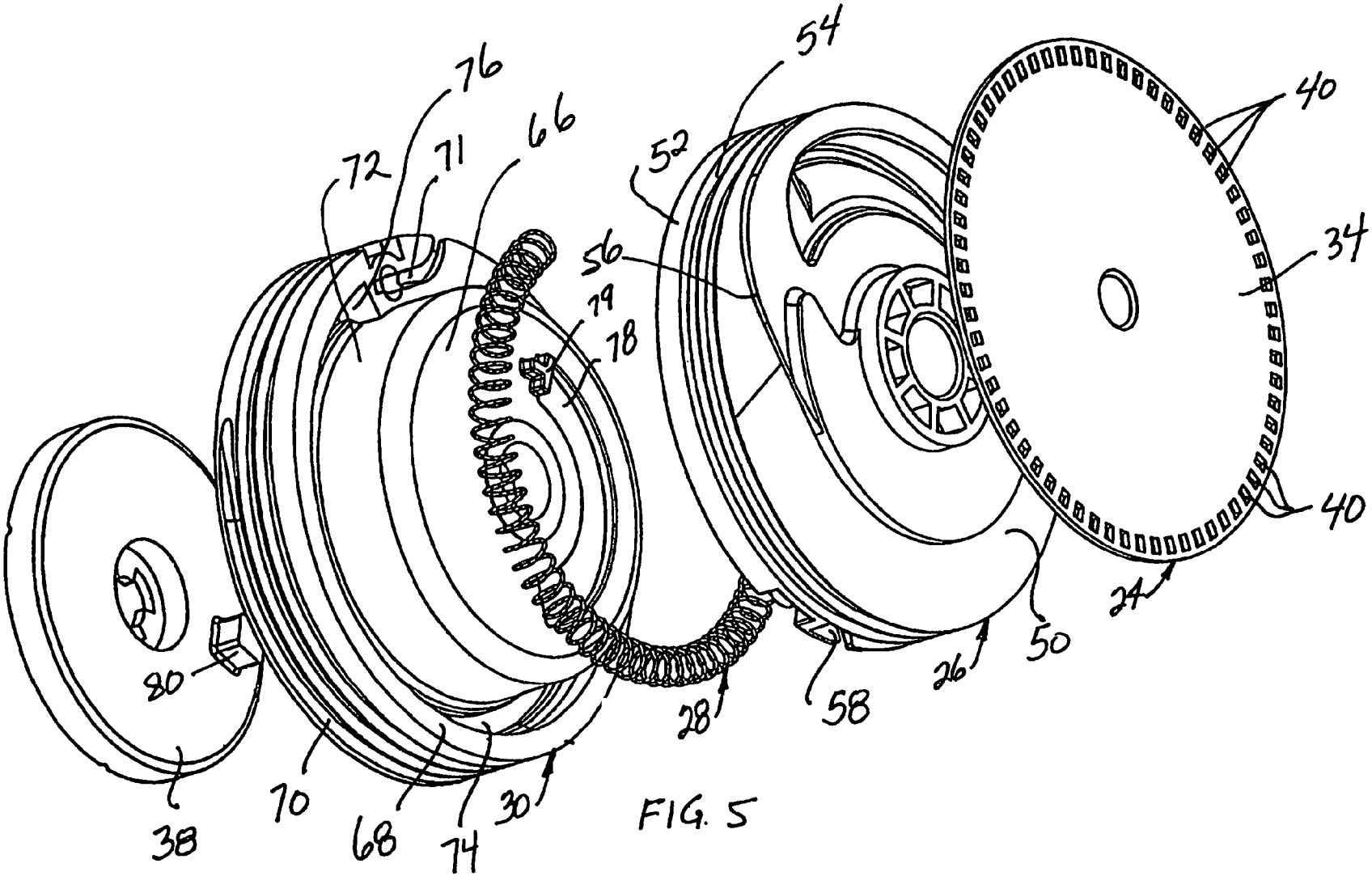
FIG. 5 is an exploded perspective view of the parts shown in FIGS. 3 and 4 taken from an opposite perspective.

Tension spring 28 is disposed in spring cavity 74 so that one end of tension spring 28 engages abutment 76 and the other end of tension spring 28 engages spring tab 64. When in tension, tension spring 28 biases drum 26 counterclockwise and drum 30 clockwise as viewed in FIGS. 1 and 5.

Rear drum 30 includes an arcuate lost motion slot 78 in the end wall 66 that aligns or at least overlaps lost motion slot 60 of front drum 26 when rear drum is nested part way in front drum 26. When so nested, stop 63 (FIG. 3) of front drum 26 is disposed in lost motion slot 78 of rear drum 30 while stop 79 of rear drum 30 is disposed in lost motion slot 60 of front drum 26. Stops 63 and 79 cooperate with the respective lost motion slots 78 and 60 to limit the relative angular displacement of front drum 26 with respect to rear drum 30.

The output friction plate 38 of electromagnetic clutch 22 fits inside and is rotatable in nesting chamber 77 as best shown in FIG. 2. Friction plate 38 includes a drive lug 80, FIG. 5, that projects through the lost motion slots 60 and 78 when the cable drive assembly 10 is put together.

Front and rear cables 82, 84 shown partially in FIG. 1, are anchored in drums 26 and 30 respectively and wound in opposite circumferential directions around the respective drums 26 and 30. Cables 82 and 84 extend from the respective drums 26 and 30 in the opposite tangential directions and out respective chutes 85 and 87 of housing 14. In operation, front cable 82 wraps onto front drum 26 while rear cable 84 unwraps from rear drum 30 and vice-versa.

Cable drive assembly 10 operates in the following manner.

The front cable 82 extends from the front cable groove of drum 26 to a sliding door bracket (not shown) in a position to be wound onto the drum 26 and into the front cable groove 54 in response to drum 26 and front cable groove 54 rotation about the longitudinal axis 21 in a forward direction (clockwise as shown in FIG. 1) which closes the sliding door of the van (not shown). When the drum 26 and front cable groove 54 rotate in a reverse or counterclockwise direction, opposite the forward direction to open the sliding door, the front cable 82 winds off of the drum 26 and out of the front cable groove 54.

Similarly, the rear cable 84 extends from the rear cable groove 70 to the sliding door bracket (not shown) in a position to be wound off of the drum 30 from the rear cable groove 70 in response to drum 30 and rear cable groove 70 rotation about the longitudinal axis 21 in the forward or clockwise direction which closes the sliding door. When the drum 30 and rear cable groove 70 rotate in the reverse or counterclockwise direction to open the sliding door, the rear cable 84 winds onto the drum 30 into the rear cable groove 28.

As shown in FIG. 1, electric motor 16 is drivingly connected to the input member 44 of electromagnetic clutch 22. For closure, electric motor 16 is energized to drive output shaft 20 and input member 44 connected to it in the forward direction, i.e. clockwise. At the same time electromagnetic clutch 22 is energized so that input member 44 drives friction plate 38. Friction plate 38 in turn rotates drum 26 and its cable groove 54 in the forward or clockwise direction when drive lug 80, after taking up any lost motion, engages the left end of lost motion slot 60 shown in figure 1. Clockwise rotation about the longitudinal axis 21 winds front cable 82 onto drum 26 to close the sliding door (not shown). As drum 26 is driven clockwise, spring tab 64 drives drum 30 clockwise via tension spring 28, winding rear cable 84 off of drum 30 and out of cable groove 70; with drum 30 being biased counterclockwise by tension spring 28 to maintain tension in cables 82 and 84.

When the sliding door of the van door is closed, electric motor 16 and electromagnetic clutch 22 are deenergized through a suitable control (not shown) that receives input signals from the optical scanner 42.

To open the sliding door (not shown), electric motor 16 and electromagnetic clutch 22 are energized to drive output shaft 20 and friction plate 38 in the rearward direction, i.e. counterclockwise. Friction plate 38 in turn rotates the rear drum 30 and its cable groove 70 in the rearward or counterclockwise direction when drive lug 80, after taking up any lost motion, engages the right end of lost motion slot 78 shown in FIG. 1. Counterclockwise rotation about the longitudinal axis 21 winds rear cable 84 onto drum 30 to open the sliding door (not shown). As drum 30 is driven counterclockwise, tension spring 63 and spring tab 64 drive front drum 26 counterclockwise winding front cable 82 out of cable groove 54 and off of drum 26; with drum 26 being biased clockwise by tension spring 28 to maintain tension in cables 82 and 84.

The decreasing cam portion 56 of front drum 26 serves to increase the tensile force in the cable to a level that is sufficient to overcome the opposing load created by the door seals during the final closing operation. Decreasing cam portion 56 is elliptical to increase cable life.

This description is intended to illustrate a preferred embodiment of the invention rather than to limit the invention. Therefore, it uses descriptive rather than limiting words. Obviously, it's possible to modify this invention from what the description teaches. Within the scope of the claims, one may practice the invention other than as described.

What is claimed is:

1. A cable drive assembly comprising:

a first drum having a helical front cable groove, the first drum being supported for rotation about a longitudinal axis;

a second drum having a helical rear cable groove and a nesting chamber inwardly of the helical cable groove, the second drum being supported for rotation about the longitudinal axis;

means including a clutch to drive the first drum in a first direction or to drive the second drum in an opposite direction, the clutch being at least partially disposed in the nesting chamber; and a spring biasing the first drum and the second drum in opposite directions, wherein the clutch includes a drive member that rotates about the longitudinal axis, the drive member being drivingly connected to the first drum via a first lost motion connection and drivingly connected to the second drum via a second lost motion connection, wherein the first drum has an arcuate slot forming part of the first lost motion connection, the second drum has an arcuate slot forming part of the second lost motion connection, and the drive member has a lug that projects through both arcuate slots to form part of the first lost motion connection and part of the second lost motion connection.

2. The cable drive assembly as defined in claim 1 wherein the first drum is a front drum having a front cable groove and the second drum is a rear drum having a rear cable groove.

3. The cable drive assembly as defined in claim 2 wherein the front drum has a front cable anchor communicating with the front cable groove and configured to receive one end of a front cable that extends from the front cable groove to be wound onto and unwound from the front cable groove in response to rotation of the front drum in the first and the opposite directions respectively; and the rear drum has a rear cable anchor communicating with the rear cable groove and configured to receive one end of a rear cable that extends from the rear cable groovee to be unwound from and wound onto the rear cable groove in response to rotation of the rear drum in the first and the opposite directions respectively.

4. The cable drive assembly as defined in claim 2 wherein the front drum and the rear drum are drivingly connected via the spring that biases the front drum and the rear drum in opposite directions.

5. The cable drive assembly as defined in claim 4 wherein the spring is a tension spring that is located in a part circular, concentric groove of one of the front drum and the rear drum that is located outwardly of the nesting chamber.

6. A cable drive comprising:

a front cup-shaped drum having a front annular rim with a helical front cable groove, the front drum being supported for rotation about a longitudinal axis;

a rear cup-shaped drum having a rear annular rim with a helical rear cable groove and having a nesting chamber, the rear drum being partially nested in the front cup-shaped drum and supported for rotation about the longitudinal axis;

means including an electromagnetic clutch to drive the first drum in a front direction or to drive the rear drum in an opposite direction, the electromagnetic clutch being disposed in the nesting chamber of the rear cup-shaped drum, a tension spring that biases the front drum and the rear drum in opposite directions when in tension, the front drum and the rear drum being drivingly connected to each other via the tension spring, and the electromagnetic clutch having a drive member that rotates about the longitudinal axis, the drive member being drivingly connected to the front drum via a first lost motion connection and drivingly connected to the rear drum via a second lost motion connection, wherein the front drum has an arcuate slot forming part of the first lost motion connection, the rear drum has an arcuate slot forming part of the second lost motion connection, and the drive member has a lug that projects through both arcuate slots to form part of the first lost motion connection and part of the second lost motion connection.

7. The cable drive assembly as defined in claim 6 wherein the front drum has a front cable anchor communicating with the front cable groove and configured to receive one end of a front cable that extends from the front cable groove to be wound onto and unwound from the front cable groove in response to rotation of the front drum in the first and the opposite directions respectively; and the rear drum has a rear cable anchor communicating with the rear cable groove and configured to receive one end of a rear cable that extends from the rear cable groove to be unwound from and wound onto the rear cable groove in response to rotation of the rear drum in the first and the opposite directions respectively.

8. The cable drive assembly as defined in claim 6 wherein the tension spring is located in a part circular, concentric groove of one of the front annular rim and the rear annular rim.

9. A cable drive assembly comprising:

a front cup-shaped drum having a front annular rim with a helical front cable groove, the front drum being supported for rotation about a longitudinal axis;

a rear cup-shaped drum having a rear annular rim with a helical rear cable groove, the rear drum being supported for rotation about the longitudinal axis and partially nested in the front cup-shaped drum with the rear annular rim juxtaposed the front annular rim, means including an electromagnetic clutch to drive the first drum in a front direction or to drive the rear drum in an opposite direction, the electromagnetic clutch being disposed in a nesting chamber of the rear cup-shaped drum, a tension spring that is located in a part circular, concentric groove of one of the front drum and the rear drum and that biases the front drum and the rear drum in opposite directions when in tension, the front drum and the rear drum being drivingly connected to each other via the tension spring, and a drive member that is attached to the electromagnetic clutch and that rotates about the longitudinal axis, the drive member being drivingly connected to the front drum via a first lost motion connection and drivingly connected to the rear drum via a second lost motion connection, the front drum having an arcuate slot forming part of the first lost motion connection, the rear drum having an arcuate slot forming part of the second lost motion connection, and the drive member having a lug that projects through both arcuate slots to form part of the first lost motion connection and part of the second lost motion connection.

10. The cable drive assembly as defined in claim 9 wherein the front drum has a front cable anchor communicating with the front cable groove and configured to receive one end of a front cable that extends from the front cable groove to be wound into and unwound from the front cable groove in response to rotation of the front drum in the first and the opposite directions respectively; and the rear drum has a rear cable anchor communicating with the rear cable groove and configured to receive one end of a rear cable that extends from the rear cable groove to be unwound from and wound onto the rear cable groove in response to rotation of the rear drum in the first and opposite directions respectively.

11. The cable drive assembly as defined in claim 9 further including an interrupter that is supported for rotation about the longitudinal axis, the interrupter having a plate that is adapted to cooperate with a scanner, and a sleeve that rotatably supports the front drum and the rear drum, the plate being at one axial end of the front and rear drums and the drive member being at an opposite axial end of the front and rear drums, the sleeve being connected to the plate at one axial end and to the drive member at the opposite axial end.

12. The cable drive assembly as defined in claim 11 wherein the electromagnetic clutch is driven by a reversible electric motor.

13. The cable drive assembly as defined in claim 12 wherein the reversible electric motor drives an input member of the electromagnet clutch via a drive shaft that extends through the sleeve of the interrupter.

* * * * *